United States Patent [19]

Frohn

[11] Patent Number: 4,645,366

[45] Date of Patent: Feb. 24, 1987

[54] CONTAINER WITH SUPERPOSED POLISHING AND APPLICATOR DEVICES

[76] Inventor: Walter Frohn, Geiselgasteigstrasse 100, D-8000 Munich 90, Fed. Rep. of Germany

[21] Appl. No.: 779,233

[22] Filed: Sep. 23, 1985

[30] Foreign Application Priority Data

Sep. 26, 1984 [DE] Fed. Rep. of Germany ... 8428327[U]
Nov. 20, 1984 [DE] Fed. Rep. of Germany ... 8434047[U]

[51] Int. Cl.[4] ..... A46B 11/00; B65D 47/42

[52] U.S. Cl. ..... 401/123; 206/229; 401/38; 401/126

[58] Field of Search ..... 401/119, 123, 124, 125, 401/118, 126, 38; 206/229

[56] References Cited

U.S. PATENT DOCUMENTS

| | | | |
|---|---|---|---|
| 3,000,035 | 9/1961 | Harris et al. | 401/123 X |
| 3,131,410 | 5/1964 | Anderson et al. | 206/229 X |
| 3,224,572 | 12/1965 | Meyerhoefer | 401/123 |

FOREIGN PATENT DOCUMENTS

| | | | |
|---|---|---|---|
| 1940593 | 2/1971 | Fed. Rep. of Germany | 401/124 |
| 545459 | 7/1956 | Italy | 206/229 |
| 1220965 | 1/1971 | United Kingdom | 401/123 |

*Primary Examiner*—Steven A. Bratlie
*Attorney, Agent, or Firm*—Collard, Roe & Galgano

[57] ABSTRACT

A container for semi-solid materials which includes a container member to accommodate such material, a lid member adapted to be repeatedly placed on and taken off the container member. The lid member includes a lid portion adapted to close a material removal opening of the container. There is furthermore an application device and a polishing device which are accommodated in concealed positions in the lid member and may be retracted from such concealed positions on a side of the lid portion remote from the container member. The devices are releasably retained in separate chambers in their concealed positions.

10 Claims, 5 Drawing Figures

CONTAINER WITH SUPERPOSED POLISHING AND APPLICATOR DEVICES

BACKGROUND OF THE INVENTION

The invention relates to containers with lids for semi-solid materials (such as those with a consistency of a shoe cream or of a wax polish). More specifically, the invention has to do with containers or cans for shoe creams with a readily opened and closed lid member whose lid portion is adapted to cover a cream removal opening of the container in the shut position of the lid member, and furthermore with a device for application of material from the container where it is needed.

A number of different containers have been proposed for shoe creams and the like with a device for putting the cream or the like on the shoe. Typically, the application member has a device in the form of a pad of foam material which is able to adapt itself to the shape of the surface to have the material from the can applied to it.

In the case of some known can designs, intended however for liquid rather than semi-solid material, a pad is placed in the opening of the container so that when the container is suitably inclined, the pad will soak up the liquid in the container and after use the opening of the container may be shut using a cap. In this case there is a danger of the container sides around the opening being fouled by the liquid and of such sides not being fully covered over by the cap when replaced so that it is then inadvisable to carry the container in a suitcase and one's hands may be dirtied simply by picking it up.

A further point is that the pad is in communication with the interior of the container even after use so that the pad is likely to become sodden and its use messy. The employment of a liquid furthermore involves certain problems as regards a reliable and foolproof sealing action.

Some of these problems are remedied by the use of a semi-solid material in the container. If in such a case the opening of the container with a fixed pad has means for applying the material, there has to be some way of getting the material onto the pad, as for example by designing the container in the form of a collapsible tube. However there is then still the shortcoming that during use involving moving the container bodily along the surface to which the material is to be applied, there is a fair chance of the material being smeared on the part of the container surrounding the opening. In addition, unintended pressure on the tube may cause an excessive amount of the material to be forced into the pad; the danger of the semi-solid material in the tube being forced against the cap will cause a further impairment of the sealing action.

In connection with use as a shoe cream container a further relevant point is that a shine is not produced merely by dabbing on the semi-solid shoe cream and it has to be rubbed up with some vigor, unlike liquid shoe-shine, which, however does not have such a beneficial effect on the footwear as semi-solid materials.

GENERAL OUTLINE OF THE PRESENT INVENTION

Consequently one aim of the present invention is to devise a container for semi-solid materials, such as more especially shoe creams, of the type initially mentioned so that the container is capable of use without leaving smears on its surroundings, as for example when placed in luggage.

A further object of the invention is to provide such a container that is instantly ready for use at all times.

As part of a still further objective of the invention, the container is to be provided with means for polishing a surface after it has had the semi-solid material applied thereto.

Expressed more generally, it may be said that the container of the invention is to be so designed that its manipulation is particularly simple and possible without any danger of dirtying one's hands or for that matter the surroundings. The design is to be such as to make possible simple and low-price production.

A still further aim of the invention is to devise a form of contaienr whose configuration has a high consumer appeal and is compact.

In order to achieve these or other aims that will become clear from the following general and specific accounts, the device for application of the material and a polishing device are arranged in their concealed positions within the lid member on the side of the lid portion facing away from the container in separate chambers in which they are releasably retained.

With this design of the container and its lid member it is possible to ensure that the application and polishing devices are available at all times and because the devices are arranged in the lid member there is no danger of the devices' dirtying the surroundings when the devices are put away in their inactive or transport positions. Owing to the arrangement in separate chambers it is not possible for one device to smear the other and more especially it is impossible for them to be fouled with material from the container, because they are shut off from it by the lid portion. Since the devices are secured in their ianctive positions within the lid member and are thus not able to fall out of it, there is a further factor making smearing of the semi-solid material on surrounding objects less likely.

The arrangement of the devices within the lid member may be such that there are separate chambers formed in the lid member to receive the application device and the polishing device. If in accordance with a preferred form of the invention the polishing device consists of a handle and a soft, yielding working or functional portion joined thereto, it is possible, in accordance with a further advantageous form of the invention, for the lid member to be in the form of a chamber to receive the polishing device and the chamber in the handle of the polishing device opens in a direction away from the lid member, when the polishing device is secured in its inactive position. Since the polishing device with the chamber formed therein for the application device in the lid member in the inactive position, the applying device also in its inactive position will be within the lid member as well so that there is a very compact construction, in which on the other hand the acting surfaces of the application and polishing devices may be made relatively large in size.

In accordance with a simple measure for retaining the devices in their concealed positions, the lid member for its part is able to be covered over by a detachable lid, although it is also possible for the devices to be locked in their chambers, as for example by detent means.

Further useful and convenient forms of the invention will be seen from the claims.

A detailed account of working examples of the invention will now follow having reference to the accompanying drawings.

LIST OF THE SEVERAL VIEWS OF THE DRAWINGS

DETAILED ACCOUNT OF EMBODIMENTS OF THE INVENTION

Figure 1:
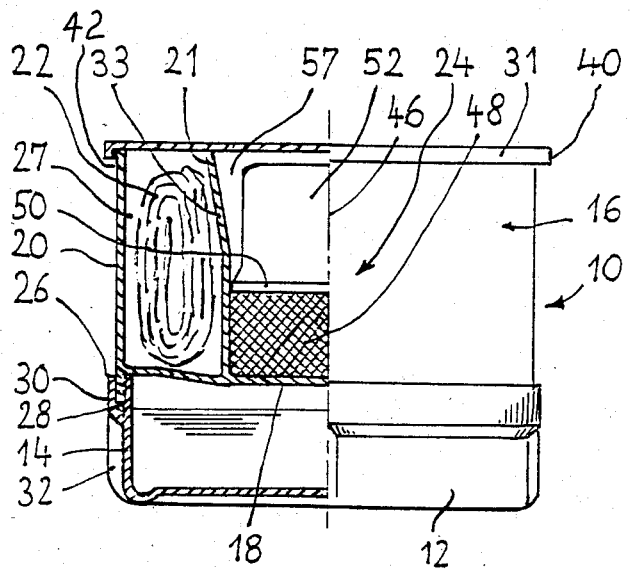
FIG. 1 is a partly sectioned side view of a first working example of the invention taking the form of a shoe cream can or container.

The shoe cream package illustrated in FIG. 1 is generally referenced 10. It is made up of four separable components, namely a container member 12 to receive the material for polishing a shoe, in the present case shoe cream, a lid member 16, which may be mounted on the container member 12 to close it and to cover its opening by means of a lid portion 18, a polishing device 22 and an applying device 24, with which, after removal of the lid member 16, the polishing material may be taken from the container member 12 and appleid where needed, in the present case on the leather of a shoe.

The container member 12 has the configuration of a squat cup with a circular plan and a generally cylindrical wall 14. The lid member 16 is similar and also has the form of a cup, the lid portion 18 forming the floor of the cup and the cylindrical wall 20 extending downwards to some extent past the lid portion 18 so that it may fit into a groove 28 to form a connection between the lid member 16 and the container member 12. The groove 28 is formed at the upper edge 26 of the container member 12 in an outwardly projecting bead 30. Ribs 32 extend down from the bead 30 to make it easier to obtain a firm grip when taking the lid member 16 off the container member. In place of the plug-in connection as described here, it would instead be possible to have a screw connection between the container member 12 and the lid member 16, this being something illustrated in FIG. 3. Such a connection is to be preferred as being more secure.

A partition wall 21 placed concentrically in relation to the wall 20 and extending upwards from the lid portion 18 divides the interior of the lid member 16 into an annular chamber 27 and a central or inner chamber 57. In the form of the invention shown in FIG. 1 the annular chamber 27 accommodates a rolled-up polishing cloth for use as a polishing device. In order to retain the polishing cloth the part 33 nearest the upper edge 42 of the lid member 16, of the partition wall is flared conically outwards. The two chambers 27 and 57 are able to be closed by a lid 31, which forms the top of the lid member 16 and whose edge 40 is able to be releasably joined to the upper edge 42 of the lid member 16.

The application device 24 is accommodated in the central chamber 57, and is made up of a soft yielding rubbing portion 48 and a handle part 46, that is made up of a disk-like base 50 and a handle 52 projecting therefrom. The rubbing portion may take the form of a pad bonded to the base 50, as for example of foamed synthetic resin, or it may take the form of a brush, whose bristles are for example set in the base 50.

The conically flared portion 33 of the partition wall 21 makes it easier to grasp the handle 52. For the sake of mold design it is best for the conical portion 33 to have longitudinal slits (not shown) to make it elastic. It is possible for the application device 24 to be secured in place in the chamber 57 by a detent connection (not shown) joining it to the partition wall 21 or for example by the gripping action of the pad, functioning as the working portion 48, and having a diameter which is suitably larger than the inner diameter of the chamber 57.

The polishing device 22 having the form of a polishing cloth may be prevented from falling out of the chamber 27 by having angularly spaced ribs, parallel to the axis on the surfaces, turned towards the chamber 27, on the wall 20 and the partition wall 21, such ribs causing the polishing cloth to assume a corrugated configuration when it is pushed into the chamber 27.

It is also possible for the lid 31 to be joined to the lid member 16 or joined with the wall 20 by way of a joint and able to be releasably clipped or the like therewith in the closed position.

Figure 2:
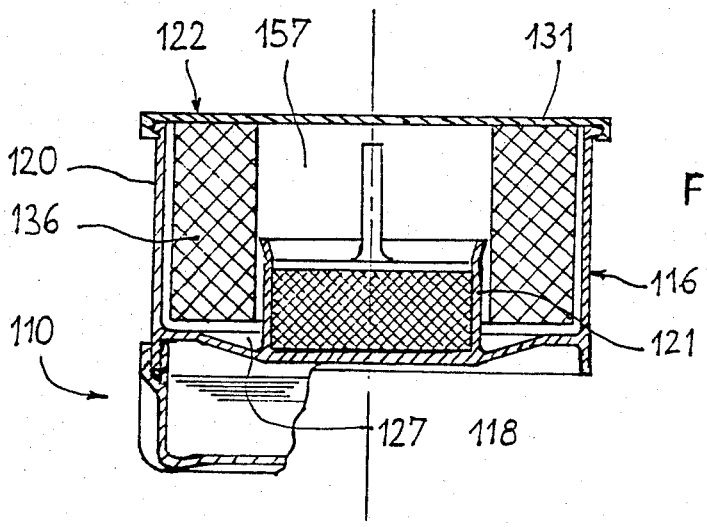
FIG. 2 shows a modified form of the lid member of the shoe cream can to be seen in FIG. 1.

In the case of the modification shown in FIG. 2 the lid member 116 is different to the extent that the partition wall 121 has a lesser axial length than the wall 120 and the lid 131, able to be removed from the lid member 116, is connected with a soft functional portion 136 to form the polishing device.

Figure 3:
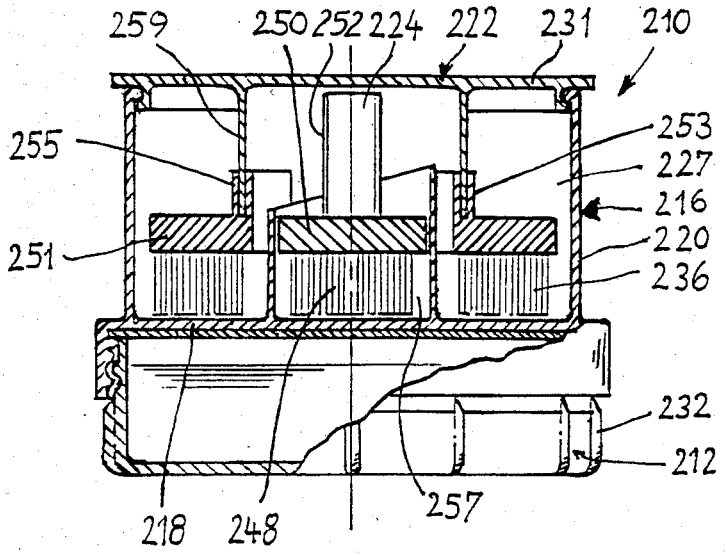
FIG. 3 shows a further possible form of the shoe cream can to be seen in FIG. 1.

FIG. 3 shows a further modification in this respect, which offers advantages from the manufacturing aspect. The lid member 216 able to be screwed to the container member 212 is provided in the way noted with an external wall 220 and a partition wall 221 so that an annular chamber 227 and a central chamber 257 are formed. The lid 231 closing off the lid member 216 forms a part of the polishing device 222, whose functional or working portion 236 is arranged in the annular chamber 227. The application device 224 and the polishing device 222 are both provided with bristles to form brush-like working portions 248 and 236, respectively. In the case of the application device 224 the bristles are set in the basic body 250 in the way noted hereinbefore. The polishing device 222 is made with an annular basic body 251 on which the bristles are set. This body has the same thickness as the basic body 250 of the application device 224 and on its inner edge there extends a concentrically slitted, annular head 253 extending in an upward direction away from the bristles. A cylindrical flange 259 fits into this slit 255 of this flange 253 and extends downwards from the lid 231. The flange 259 is securely joined to the flange 253, as for example by adhesive or by being welded.

In order to simplify production the basic body 251 and the basic body 250 with the handle 252 placed therein are made in one piece with a frangible connection and only separated after fitting this integral body with the bristles, following which the basic body 251 is joined with the flange 259 of the lid 231. The moldings are preferably made of synthetic resin.

In order to facilitate introduction of the brush-like functional portion 248 of the application device 224 into the chamber 257, the upper edge of the partition wall runs in a plane that is inclined in relation to the axis of the can.

The container member 212 has a knurled bead 232 to make it easier to grasp.

Figure 4:
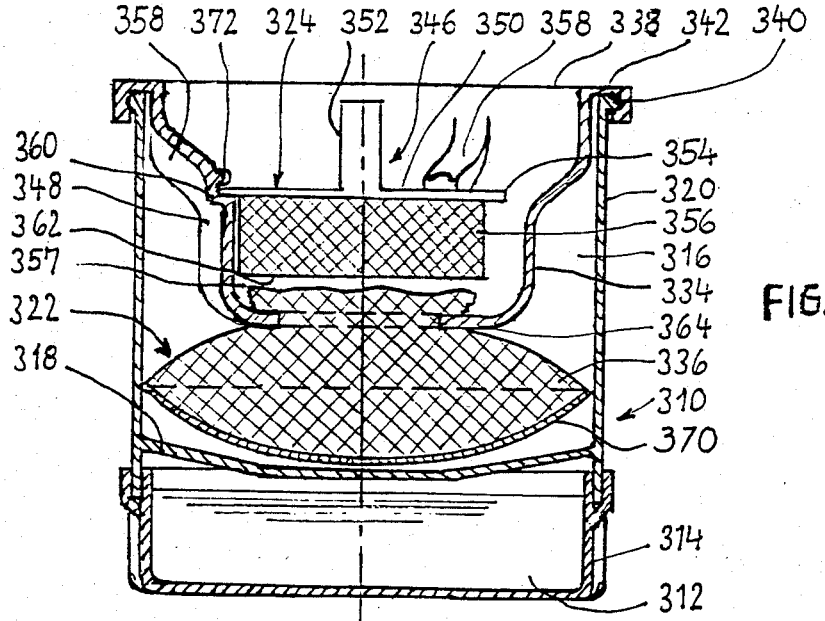
FIG. 4 is a section through a further possible form of shoe cream can.

The working example of the invention to be seen in FIG. 4 differs in certain essential respects from the forms of the invention described so far, because the chamber 357 for the application device 324 is not arranged directly in the lid member 316 but rather indirectly in the interior of the lid member 316 via the polishing device 322 placed in the lid member 316.

The can to be seen in FIG. 4 is generally referenced 310. The container member 312 and the lid member 316 are generally similar to the corresponding parts of the embodiments of the invention described so far as regards the cylindrical walls 314 and 320, respectively, and the lid portion 318. On the other hand however the polishing device 322 has a different form. It is made up of a handle 334 and a soft functional portion 336 fixed thereto in the form of a polishing body of foam material, which is in a position next to the lid section 318 when the polishing device 322 assumes its concealed position in the lid member 316.

The handle 334 is in the form of a generally bell-like body of revolution, which flares outwards in a direction away from the functional portion 336 as far as the opening of the lid member 316, the end 338, remote from the functional portions 336, of the handle 334 being open. At this open end 338 the handle 334 is able to be connected along its periphery 340 with the upper edge 342 of the lid member positively, as for example by detent or screw means.

The application device 324 consists, in the way explained above, of a handle member 346 and a cylindrical functional portion 348, joined thereto, in the form of a pad of foam material, as for example foam rubber. The handle member 346 is made up of a basic body 350 and a handle 352 molded thereon. The disk-like basic body 350 is so designed that its edge 354 overlaps the periphery 356 of the functional portions 348.

There is a chamber 357 in the functional portion, nearest the polishing device 322, of the handle 334 in order to accommodate the application device 324, and the same may be pushed into it from the open side of the handle 334. In order to hold the application device 324 in place there are a few, as for example three, locating ribs 358, running in the direction of insertion, i. e. in the axial direction which are made by embossing the wall of the handle 334. Such ribs 358, which are spaced out in the peripheral direction, each have a support shoulder 360 for the edge 354 of the handle member 346 of the application device 324, the application device 324 being entirely accommodated in the interior of the handle 334 of the polishing device 322, when the edge 354 is rested on the support shoulders 360, where on the other hand the end face 362, turned away from the handle member 346, of the functional portion 348 is still spaced from the lower end wall 364 of the handle 334 facing the lid portion 318.

Figure 5:
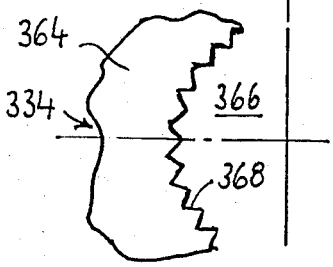
FIG. 5 shows a part of the retaining opening in the handle of the polishing device.

This end wall 364 of the handle 334 is provided with a holding opening 336 with a serrated edge 368 (see FIG. 5).

The functional portion 336 consists of a piece of foam material which before assembly is cylindrical and whose end facd turned away from the handle 334, is furnished with a coating of flocks of material such as artificial silk or polyamide fibers. At any rate the flock coating is made with a material, which has good slip and polishing properties when the polishing device 322 is in use. This piece of foam material has its end free of flocks in the holding opening 366, the piece of foam material being compressed in a known manner, the end face 370 with flocks of material thereon bending outwards convexly. The diameter of the piece of foam material is such that the functional portion 336 nearly fills the whole of the inner cross section of the lid member 316 and therefore extends far past the end nearest to it of the handle 334 on the side so that the polishing device 322 is readily manipulated. Furthermore, the face or area of the functional portion 336 is particularly large in this form of the invention because the part of the area is utilized which is needed in the case of the polishing devices 122 and 22 in view of the space requirement for the chambers 157 and 257. The handle function is still further improved by the special shape of the handle 334 owing to the embossed locating ribs 358 therein.

It is also possible for the functional portion 336 to be formed, if desired, by a brush-like array of bristles on the end wall 364, which will then preferably occupy generally the entire inner cross section of the lid member 316.

There is furthermore the possibility of making the locating ribs 358 resilient and providing a detent projection 372 suitable to fit round the edge 354 of the basic body 350. However it is also possible to have resilient lugs formed on the handle member 346, such lugs being able to cooperate with a bead, projecting from the inner side of the handle 334 into the chamber 357 accommodating the application device 324, or with an undercut part at the open end 338 of the handle 334 in order to secure the application device 324 in the chamber 357.

Since the polishing device 322 is placed in its concealed position in the cylindrical chamber 327 formed in the lid member 316, the application device 324, also inserted into the chamber 357, is in the interior of the lid member 316.

Preferably the lid member 316 is manufactured of a transparent material, as for example polystyrene so that the interior of the can 310 may be seen from the outside.

For use the lid member 16, 116, 216 or 316, respectively, is taken off the container member 12, 112, 212 or 312, respectively, and the application device 24, 124, 224 or 324, respectively, is taken out of the chamber 57, 157, 257 or 357 in order to put on the material from the container. In this respect it is possible for the application device to be moved in circles over the material, something that reduces the danger of the outer side of the container member 12, 112, 212 or 312, respectively, being damaged. After use the application device 24, 124, 224 or 324, respectively, is placed in the chamber 57 and the polishing device 22, 122, 222 or 322 is respectively taken from the chamber 27, 127, 227 or 327, respectively, and put on the surface provided with the material and after polishing is put back in the chamber 27, 127, 227 or 327, respectively. The soiled devices are kept out of the way in the concealed position inside the can or their respective lid member 16, 116, 216 or 316, respectively, so that when properly used there is no danger of the outside of the can becoming fouled with polish and it may for example be put in a suitcase in perfect confidence, more especially seeing that it on the one hand has all parts necessary for care of shoes, is compact in form and has a sophisticated design while at the same time it is low in price.

In order to facilitate comparison of the different working examples of the invention the reference numerals used for functionally equivalent parts are the same in the last two digits and for avoiding unnecessary repetition not all such parts are described again in the account of each embodiment. Therefore as a supplement to the account of the embodiments in FIG. 2 the can 110, the lid portion 118, the chamber 127 and the chamber 157 are noted whereas in connection with FIG. 3 the can 210 and the lid portion 218 are referenced.

I claim:

1. A container for semi-solid materials comprising a container member to accommodate such material, a lid member adapted to be repeatedly placed on and taken off said container member, said lid member including a lid portion adapted to close a material removal opening of said container, an application device and a polishing device, said devices being adapted to be accommodated in concealed positions in said lid member and able to be retracted from such concealed positions on a side of said lid portion remote from said container member, said polishing device including a handle and a softly yielding functional portion joined thereto, said lid member defining a chamber opening away from the container member and divided by a partition into an inner chamber and an outer chamber placed around the same, said inner and said outer chambers opening in the same direction, said application device being concealed in said inner chamber when not in use and said polishing device being concealed in said outer chamber when not in use.

2. The container as claimed in claim 1 comprising a lid for covering over and closing said lid member.

3. The container as claimed in claim 2 wherein said lid takes the form of a handle for said polishing device.

4. The container as claimed in claim 1 wherein said application device is made in the form of a handle and a softly yielding functional portion joined thereto.

5. The container as claimed in claim 1 wherein said application device is made in the form of a handle and a softly yielding functional portion joined thereto and wherein said functional portion of said polishing device is in the form of bristles joined to the handle thereof to take the form of brushes.

6. A container for semi-solid materials comprising a container member to accommodate such material, a lid member adapted to be repeatedly placed on and taken off said container member, said lid member including a lid portion adapted to close a material removal opening of said container, an application device and a polishing device, said devices being adapted to be accommodated in concealed positions in said lid member and able to be retracted from said concealed positions on a side of said lid portion remote from said container member, said polishing device including a handle and a softly yielding functional portion joined thereto, said lid member defining a chamber opening in a direction away from said lid member to accommodate said polishing device, and the handle of said polishing device defining a chamber to receive said application device for positive connection thereto, said chamber in said handle opening in a direction away from said container member when said polishing device is in its concealed position, and said handle being releasably and positively joined to said container member.

7. The container as claimed in claim 6 comprising a lid for covering over and closing said lid member.

8. The container as claimed in claim 7 wherein said lid takes the form of a handle for said polishing device.

9. The container as claimed in claim 6 wherein said application device is made in the form of a handle and a softly yielding functional portion joined thereto.

10. The container as claimed in claim 6 wherein said application device is made in the form of a handle and a softly yielding functional portion joined thereto and wherein said functional portion of said polishing device is in the form of bristles joined to the handle thereof to take the form of brushes.

* * * * *